US005509365A

United States Patent [19]

Cash

[11] Patent Number: 5,509,365

[45] Date of Patent: Apr. 23, 1996

[54] MULTI-NEEDLE QUILTER WITH COMPONENT DRIVE ASSEMBLIES

[75] Inventor: David R. Cash, Louisville, Ky.

[73] Assignee: James Cash Machine Co., Inc., Louisville, Ky.

[21] Appl. No.: 439,963

[22] Filed: May 12, 1995

[51] Int. Cl.[6] ..... D05B 11/00

[52] U.S. Cl. ..... 112/117

[58] Field of Search ..... 112/117, 200, 112/166, 165, 80.4, 80.41, 80.5, 80.1, 80.42, 470.27, 2.1, 199

[56] References Cited

U.S. PATENT DOCUMENTS

| | | | |
|---|---|---|---|
| 3,192,886 | 7/1965 | Cash, Jr. | 112/470.27 |
| 3,749,037 | 7/1973 | Cash | 112/117 |
| 4,006,696 | 2/1977 | Robertson | 112/117 |
| 4,470,360 | 9/1984 | Gerlach | 112/80.5 X |

FOREIGN PATENT DOCUMENTS

| | | | |
|---|---|---|---|
| 2154359 | 5/1973 | Germany | 112/117 |

*Primary Examiner*—Ismael Izaguirre

*Attorney, Agent, or Firm*—Middleton & Reutlinger; James C. Eaves, Jr.

[57] ABSTRACT

A multi-needle quilting machine used, for example, to sew mattress ticking, filler such as foam, and backing together, the top having a desired sewn pattern thereon. The ticking/filler/backing are pulled straight through the quilter. A front needle bar and parallel rear needle bar spaced therefrom, the bars having needles at preselected locations, are moved left and right, with respect to the movement of the ticking/filler/backing, to create the desired pattern. The front and rear needle bars are operated in an out of phase relationship, that is, when the front needle bars are moving down, the rear needle bars are moving up. Also, movements of the needle bar cranks can be set such that the cranks for the front needle bars rotate in one direction and cranks for the rear needle bars rotate in the opposite direction. In sewing, loopers are moved left and right and, also, rocked front and back to create an oblong path. A spreader rotating shaft has a looper rotating shaft transverse thereto. Transverse gears on both shafts engage so that the rotation of the spreader shaft rotates the transverse shaft. A looper crank on each end of the spreader shaft, the looper cranks having off-set bores therein, is used to create the left and right movement of the loopers. Eccentrics are used to rock the loopers front and back.

10 Claims, 16 Drawing Sheets

MULTI-NEEDLE QUILTER WITH COMPONENT DRIVE ASSEMBLIES

BACKGROUND OF THE INVENTION

Field of the Invention

The present invention relates to a multi-needle quilting machine employable, for example, in mattress top, comforter, bedspread, and sleeping bag manufacturing. For example, the quilter is used to sew mattress ticking, filler such as foam, and backing together, the top having a desired sewn pattern thereon. By balancing quilter components, the weight of the quilter can be greatly reduced.

SUMMARY OF THE INVENTION

The present invention is for a multi-needle quilting machine. The quilter is used to sew mattress ticking, filler such as foam, and backing together, the top having a desired sewn pattern thereon. The ticking/filler/backing are pulled straight through the quilter. A front needle bar and parallel rear needle bar spaced therefrom, the bars having needles at preselected locations, are moved left and right, with respect to the movement of the ticking/filler/backing, to create the desired pattern. The front and rear needle bars are operated in an out of phase relationship, that is, when the front needle bars are moving down, the rear needle bars are moving up. Also, movements of the needle bar cranks can be set such that the cranks for the front needle bars rotate in one direction and cranks for the rear needle bars rotate in the opposite direction. This helps permit the weight of the quilter to be reduced.

In making a two thread chain stitch, needles and associated presser feet, spreaders, and loopers are employed, the spreaders and loopers being below the material being sewn. The spreaders are moved in a circular path in a single plane which is accomplished by off-set bores in the end of a rotating spreader shaft. The loopers require more complicated movement. The loopers move in a somewhat oblong path. The loopers are moved left and right and, also, rocked front and back to create the oblong path. A spreader rotating shaft has a looper rotating shaft transverse thereto. Transverse gears on both shafts engage so that the rotation of the spreader shaft rotates the transverse shaft. A looper crank on each end of the spreader shaft, the looper cranks having off-set bores therein, is used to create the left and right movement of the loopers. Eccentrics are used to rock the loopers front and back.

Finally, the present invention comprises a multi-needle quilting machine including: a sewing frame carriage having at least one upper sewing assembly and a lower sewing assembly, the at least one upper sewing assembly having an upper main shaft passing therethrough, the lower seeing assembly having a lower main shaft passing therethrough, the sewing frame carriage having means for driving the upper and lower main shafts; the at least one upper sewing assembly having a front needle bar having at least one needle connected thereto; the at least one upper sewing assembly having a corresponding front presser foot bar having at least one presser foot connected thereto; the at least one upper sewing assembly having a rear needle bar having at least one needle connected thereto; the at least one upper sewing assembly having a corresponding rear presser foot bar having at least one presser foot connected thereto; the at least one upper sewing assembly having means for driving the front needle bar and the corresponding front presser foot bar and the rear needle bar and the corresponding rear presser foot bar vertically up and down, the driving means being coupled to the upper main shaft, where driving means moves the front needle bar with the corresponding front presser foot bar and the rear needle bar with the corresponding rear presser foot bar in an out of phase relationship; the lower sewing assembly having a front spreader bar having at least one spreader connected thereto; the lower sewing assembly having a corresponding front looper bar having at least one looper connected thereto; the lower sewing assembly having a rear spreader bar having at least one spreader connected thereto; the lower sewing assembly having a corresponding rear looper bar having at least one looper connected thereto; the lower sewing assembly having means for driving the front spreader in a first horizontal circle and the rear spreader bar in a second out of phase horizontal circle, the driving means being coupled to the lower main shaft; the lower sewing assembly having means for driving the front looper bar in a left and right direction and means for rocking the front looper in a front and back direction, where the front looper bar moves in a first oblong pattern; the lower sewing assembly means for driving the front looper bar in a left and right direction also driving the rear looper bar in an out of phase right and left direction, the means for rocking the front looper in a front and back direction also rocking the rear looper bar in an out of phase left and right direction, where the rear looper bar moves in a second out of phase oblong pattern.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
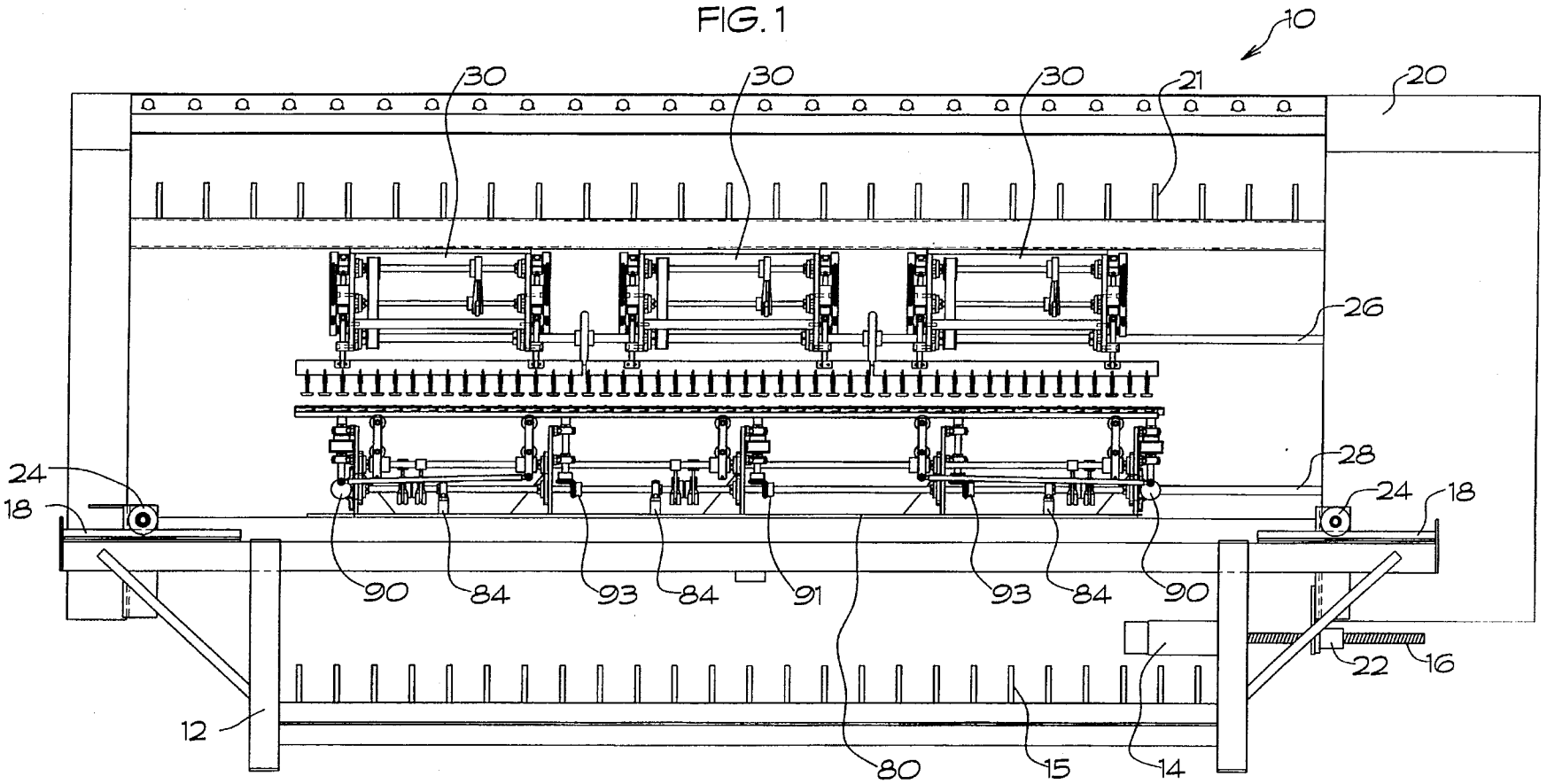
FIG. 1 shows a front view of a multi-needle quilter of the present invention.

With reference to FIG. 1, the multi-needle quilter 10 of the instant invention is shown having a base frame 12 and a sewing frame or carriage 20. The pull rollers which pull the sewn ticking/foam/backing, for example, are not shown, nor are the assemblies which retain the individual ticking, foam, and backing components and receive the completed product.

The multi-needle quilter 10 is shown having a capability of up to 99 needles and for sewing a standard width of 86 inches (218½ centimeters). However, these are not limiting to the present invention, as, for other quilting operations, other needle configurations and sewing widths would be used by those skilled in the art.

The base frame 12 includes a motor 14 which drives screw 16. Base frame 12 also includes channels 18. Sewing frame 20 includes a threaded bore portion 22 which receives screw 16. Frame 20 includes rollers 24 which are received by respective channels 18. Motor 14 is operated as desired, for example, by a computer controller, not shown, to turn screw drive 16. This causes sewing frame 20 to move left or right, depending on the rotation of screw drive 16. For example, frame 20 can be moved left/right about 14 inches (35.5 centimeters). The ticking/foam/backing is pulled straight through the quilter 10. With a desired number of needles at desired locations, the controlled left/right movement of frame 20 causes desired patterns to be sewn. With left/right movement of the frame 20, the forward movement of the ticking foam/backing can be variably controlled to ensure an equal spacing between the stitches, if desired.

Quilter 10 is designed to sew a standard type 401 two thread lock chain stitch. To do so, needles, spreaders, loopers, and presser feet are employed. With the orientation of FIG. 1, the needles and presser feet are moved vertically up and down, the spreaders are moved in a circle in a horizontal plane, and the loopers are moved left/right and "rocked" front/back to create an oblong movement. FIG. 1 shows a plurality of top thread bars 21 which hold spools of thread, not shown. Thread from each upper spool is fed to a needle. To provide the second thread, base frame 12 contains similar thread bars 15, each which can receive a spool of thread.

Throat plates cover the spreader/looper portions. The throat plates have bores which receive the needles. For example, the presser feet move vertically downward to about ⅝ inch (1.6 centimeter) of the throat plates. The quilter 10 is designed, for example, to sew up to 1½ inch (3.8 centimeter) thick foam filler without adjustment.

Quilter 10 is designed to have counter-balancing movements to permit the machine to be of greatly reduced weight over prior art machines. Quilter 10 is also designed with sealed bearings for oil-free operation.

Figure 3:
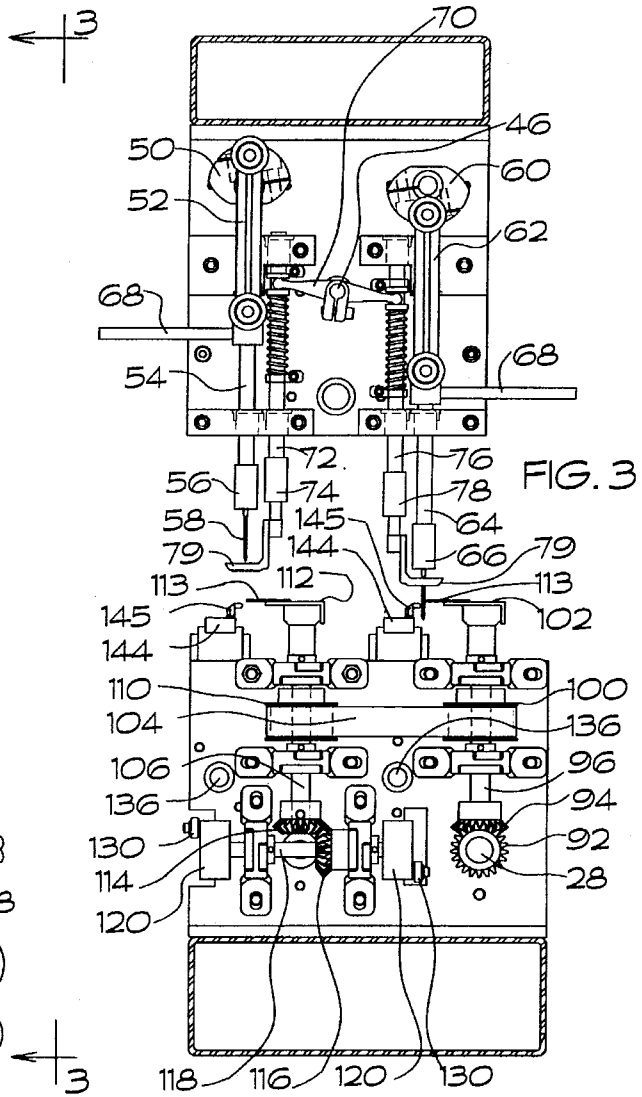
FIGS. 3, 5, 7, 9, 11, 13, 15, 17, 19, 21, 23, and 25 show respective side views of the quilter portion of FIGS. 2, 4, 6, 8, 10, 12, 14, 16, 18, 20, 22, and 24.
Figure 2:
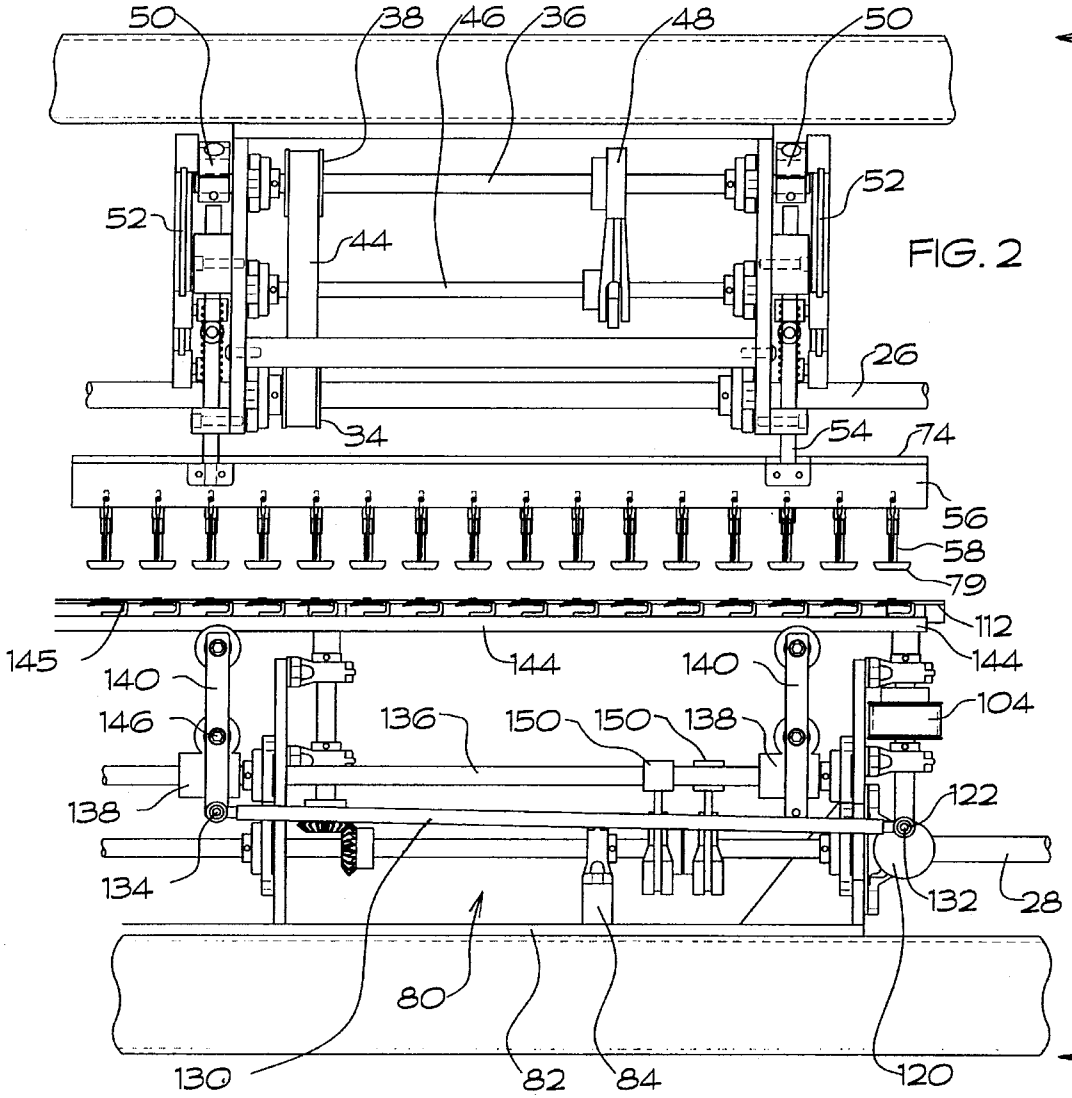
FIGS. 2, 4, 6, 8, 10, 12, 14, 16, 18, 20, 22, and 24 show front views of a selected portion of the quilter of FIG. 1, each next view showing the sewing movement with the needle bar cranks advanced thirty degrees.
Figure 5:
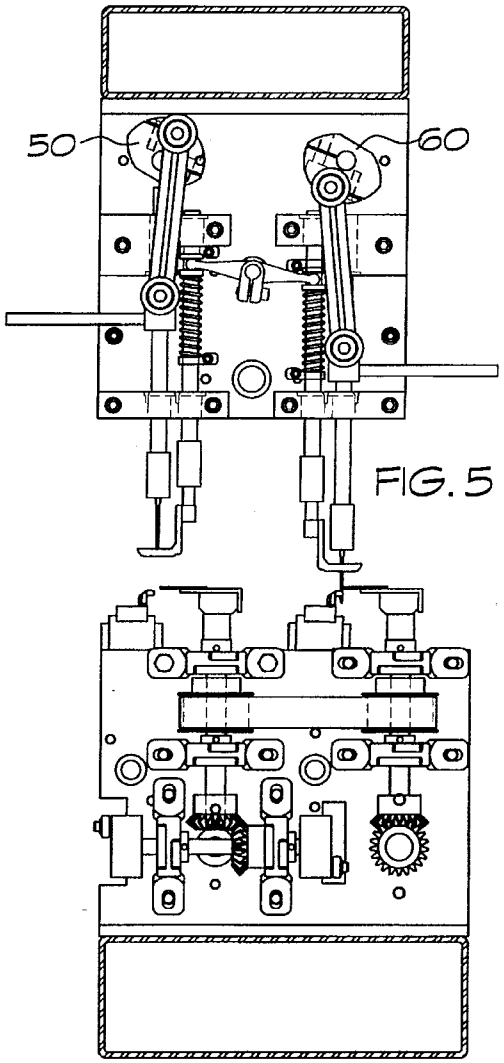
Figure 4:
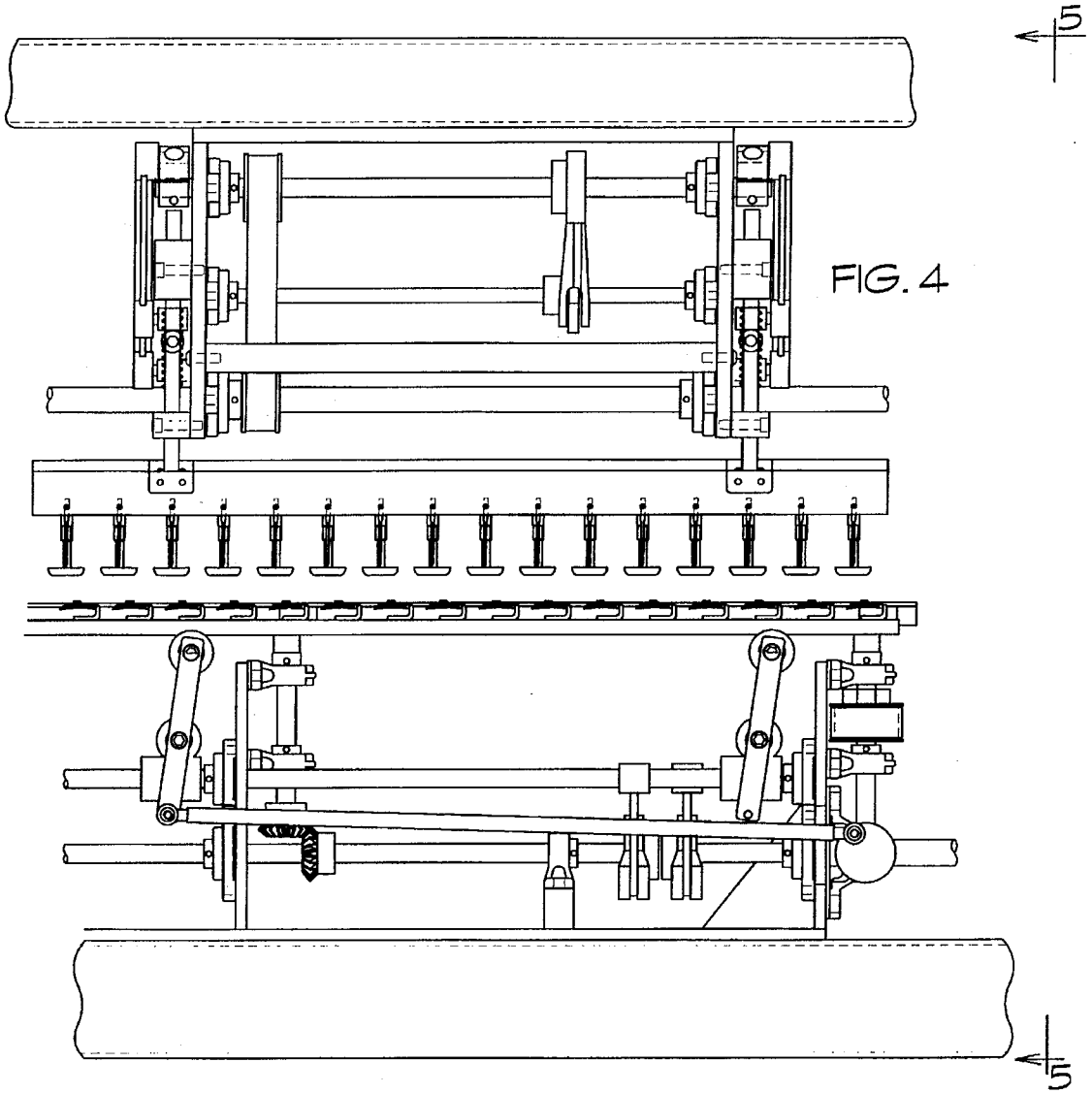
Figure 7:
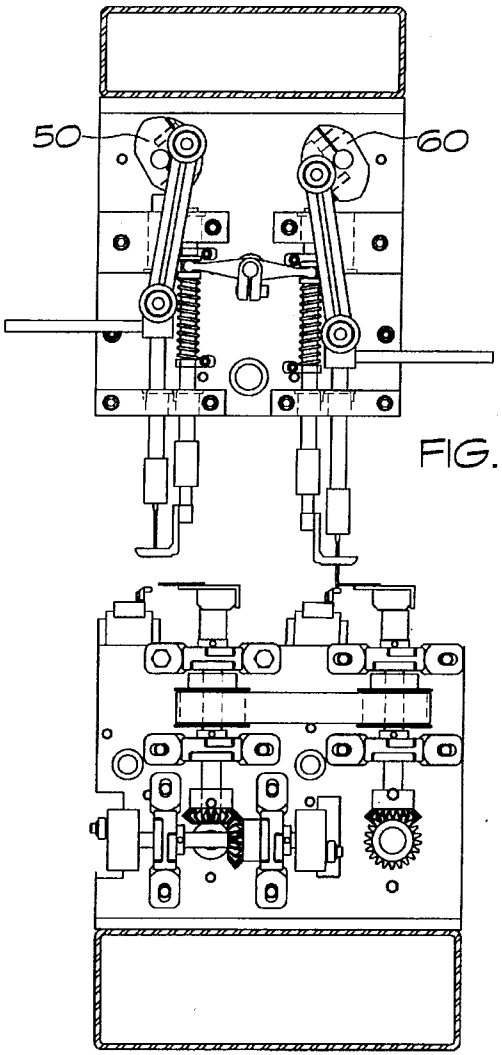

With reference to FIGS. 1–3, FIG. 1 shows a front view of the quilter 10 having three side by side upper sewing assemblies 30 and one lower sewing assembly 80. FIG. 2 shows the furthest right upper sewing assembly 30 and the portion of the lower sewing assembly 80 thereunder. FIG. 3 shows a right side view of the portion of FIG. 2. As was previously mentioned, the quilter could easily be designed to sew over a different length. Therefore, different numbers of upper assemblies from one up could be employed with a corresponding lower assembly. A motor, not shown, is used to drive an upper main shaft 26, which operates the needle bars and presser feet, and is also used to drive a lower main shaft 28, which operates the spreaders and loopers.

With reference to FIGS. 1–3 and 26, one upper assembly is explained. A frame 32 has upper main shaft 26 passing therethrough. Shaft 26 has a drive gear 34 thereon. Frame 32 supports a front needle shaft 36, having a drive gear 38 thereon, and also supports a rear needle shaft 40, having a drive gear 42 thereon; shafts 26/36, 26/40, and 36/40 being in a parallel alignment and gears 34, 38, and 42 being in a vertical plane. A drive belt 44 connects gears 34, 38, and 42. Therefore, as upper main shaft 26 is rotated, belt 44 causes shafts 36 and 40 to rotate. With the one belt configuration, shafts 36 and 40 rotate in the same direction.

Figure 27:
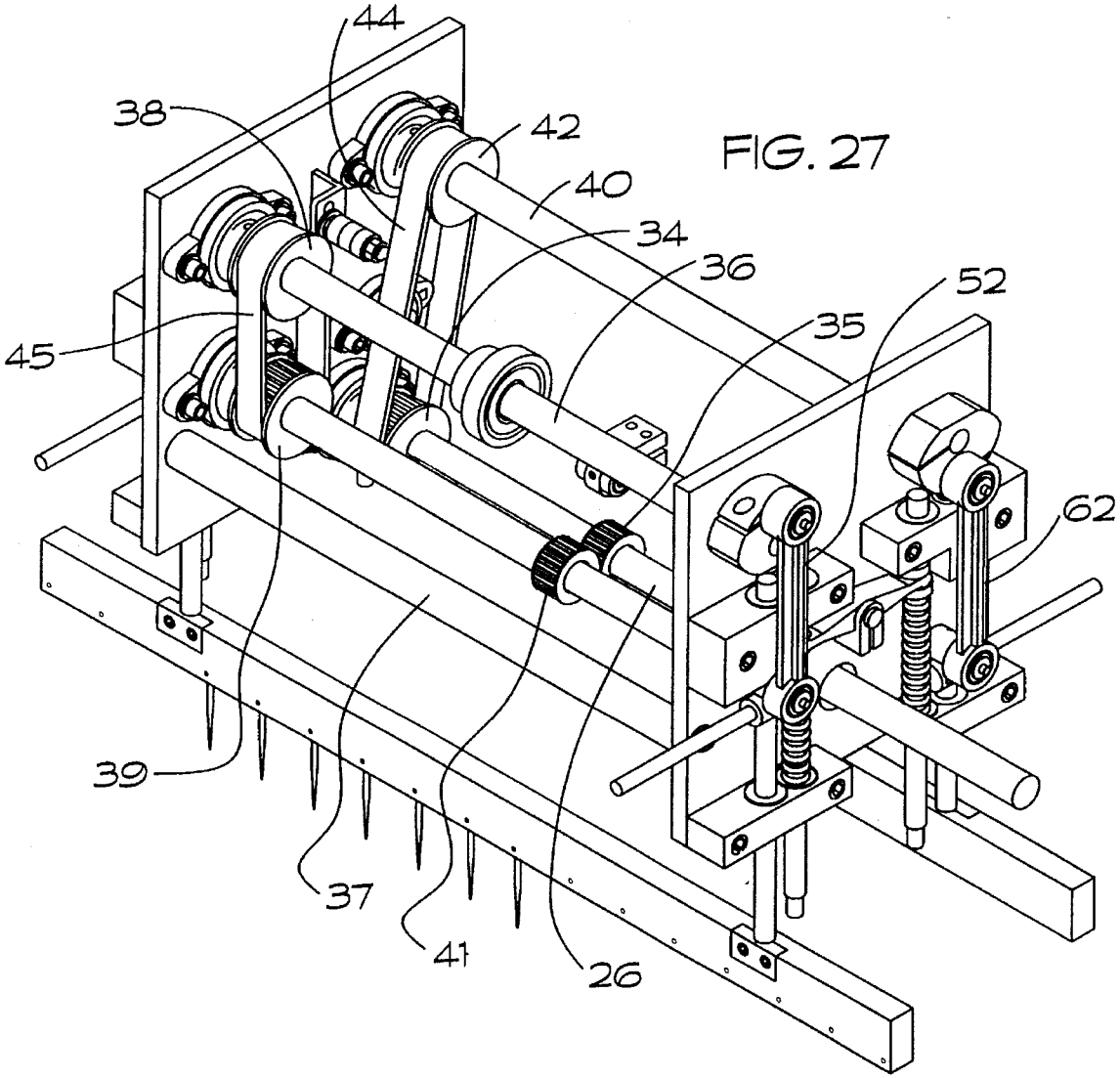
FIG. 27 shows a perspective view of a selected portion of an alternative upper sewing assembly, wherein the needle bar cranks rotate in opposite directions; and, FIG. 28 shows a portion of the spreader/looper drive assembly.
Figure 28:
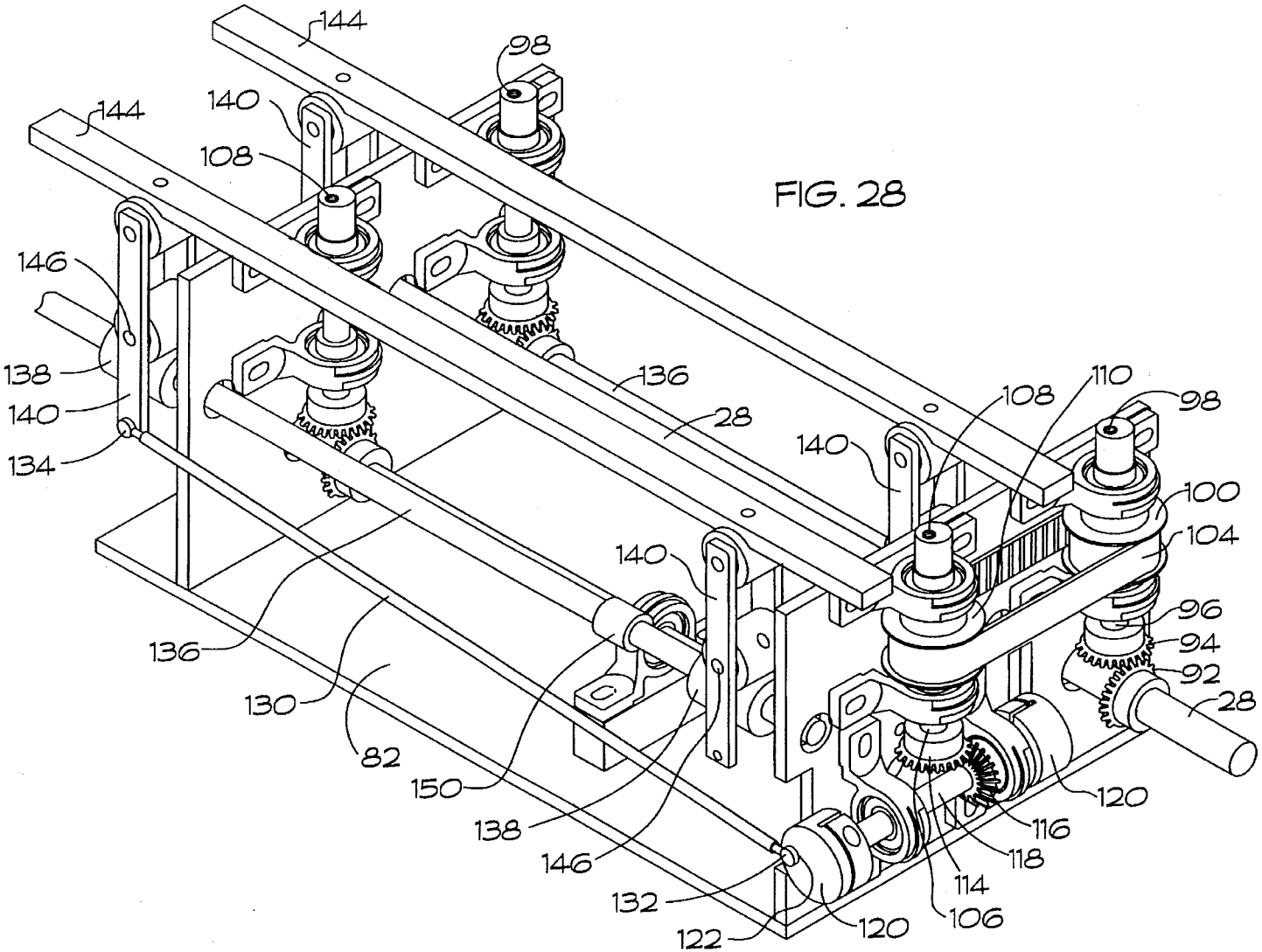

FIG. 27 teaches an alternative configuration to cause shafts 36 and 40 to rotate in opposite directions. This configuration causes the quilter to be even "more balanced". This configuration employs an additional shaft 37, having a drive gear 39 thereon. Upper main shaft 26 has a gear 35 thereon and shaft 37 has a gear 41 thereon, gears 35 and 41 meshing. Belt 44 is connected between gear 34 and 42i so that shaft 40 rotates as in the example of FIG. 26. A additional belt 45 is connected between gears 39 and 38. This results in shaft 36 rotating in the opposite direction of shaft 40.

With reference back to FIGS. 1–3 and 26, the two ends of front needle shaft 36 have a front needle bar crank 50 connected thereto and the two ends of rear needle shaft 40 have a rear needle bar crank 60 connected thereto. Each front needle bar crank 50 has a front needle bar connector link 52 connected thereto, the connection being off-set from the axis of shaft 36. Each rear needle bar crank 60 has a rear needle bar connector link 62 connected thereto, the connection being off-set from the axis of shaft 40. Therefore, as shafts 36 and 40 rotate, the connected ends of links 52 and 62 move in a circle about the axes of the respective shafts 36 and 40. The other ends of links 52 and links 62 are connected to respective front needle bar shafts 54 and rear needle bar shafts 64. Shafts 54 and 64 are limited to vertical up and down movement, caused by the turning of shafts 36 and 40, the turning of cranks 50 and 60, and the movement of links 52 and 62, respectively.

Two front needle bar shafts 54 are connected to a front needle bar 56. Likewise, two rear needle bar shafts 64 are connected to a rear needle bar 66. Needle bars 56 and 66 can have needles 58 connected thereto at desired locations, determined by the pattern to be sewn.

Each needle 58 has a presser foot 79 which works in conjunction with the needle. Therefore, front needle bar 56 has a corresponding front presser bar 74 and rear needle bar 66 has a corresponding rear presser bar 78. Frame 32 supports a presser foot shaft 46, shaft 46 being individually parallel to shafts 26, 36, and 40. Presser foot rock eccentrics 48 are connected between shaft 36 and shaft 46. Eccentrics 48 cause shaft 46 to oscillate back and forth as shaft 36 rotates. The two ends of presser foot shaft 46 have a presser bar rock frame 70 connected thereto. A front end of each presser bar rock frame 70 is connected to a front presser bar shaft 72 and a rear end of each presser bar rock frame 70 is connected to a rear presser bar shaft 76. Two front presser bar shafts 72 are connected to a front presser bar 74. Likewise, two rear presser bar shafts 76 are connected to a rear presser bar 78. Presser bars 74 and 78 can have presser feet 79 connected thereto at desired locations, determined by the location of needles 58.

With reference to FIGS. 1–3 and 28, the lower sewing assembly 80 is explained. Assembly 80 includes a frame 82 having supports 84 for lower main shaft 28. As was mentioned earlier, assembly 80 moves the loopers and spreaders. The assembly which drives the spreader bars 112 and 102 and drives looper bars 144 left and right is identified by the numeral 90. The assembly 90 includes a gear 92 on lower main shaft 28. Gear 92 meshes with a transverse gear 94 connected to vertical rear spreader bar shaft 96. The top of shaft 96 contains an off-set bore 98 therein. Shaft 96 has a gear 100 thereon.

A front spreader bar shaft 106, with a top off-set bore 108 therein, has a gear 110 thereon. A timing belt 104 connects gears 100 and 110 to cause shafts 96 and 106 to simultaneously rotate in the same direction. The lower end of shaft 106 has a gear 114 thereon. A transverse gear 116, having a shaft 118 therethrough, meshes with gear 114. Shaft 118 has a looper crank 120 at each end, one crank for front loopers and one crank for rear loopers. Each looper crank 1210 has an off-set bore 122 therein.

With particular reference to FIG. 1, it is seen that lower sewing assembly 80 has an assembly 90 at each end. A similar assembly 91 is toward the center portion of assembly 80. Assembly 91 includes the portions of assembly 90 which drive the spreader shafts, those being gears 92/94, shafts 96 and 106 with respective gears 100 and 110 thereon, with timing belt 104 therebetween. Between center assembly 91 and each end assembly 90 is an assembly 93. Each assembly 93 contains gears 92/94 and a shaft 96. No timing belt 104 is employed with assemblies 93.

FIGS. 1–3 show a front spreader bar 112 is connected into bores 108 of shafts 106. Likewise, rear spreader bar 102 is connected into bores 98 of shafts 96. The rotation of shafts 96/106 with off-set bores 98/108 causes respective bars 102/112 and spreaders 113 to rotate in a circular pattern.

For front looper bar 144, FIG. 1 shows five looper couplings 138 on a looper rock shaft 136. A looper pivot 140 is connected to each coupling, 146 identifying the pivot point. Front looper bar 144 is connected to the top of the five looper pivots 140. Looper drive bars 130 are connected to off-set bores 122 in looper cranks 120, identified as location 132, at the two end assemblies 90. The right looper drive bar 130 is connected to the base of the second looper pivot 140 from the right, identified as location 134. The left looper drive bar 130 is connected to the base of the second looper pivot 140 from the left, also identified as location 134. The connections at locations 132 and 134 employ rod end bearings to alleviate stress on bars 130 when looper rock shaft 136 is rocked back and forth by eccentrics 150 connected between shafts 28 and 136.

As shaft 28 rotates, the connectivity through gears 92/94, shafts 96/106 via gears 100/110 and belt 104, gears 114/116, shaft 118, looper crank 120, looper drive bar 130, to looper pivot 140 causes front looper bar 144 and loopers 145 thereon to move left/right. Also, as shaft 28 rotates, eccentrics 150 connected between shafts 28/136 causes shaft 136 to oscillate back and forth. This causes front looper bar 144 and loopers 145 to move front/back. With this combined movement, loopers 145 travel in an oblong pattern.

The rear looper bar 144, with couplings 138, looper pivots 140, looper rock shaft 136, and eccentrics 150 are similarly arranged. FIG. 3 shows the end of rear looper rock shaft 136 and the end of rear looper drive bar 130 connected to rear looper crank 120.

Figure 6:
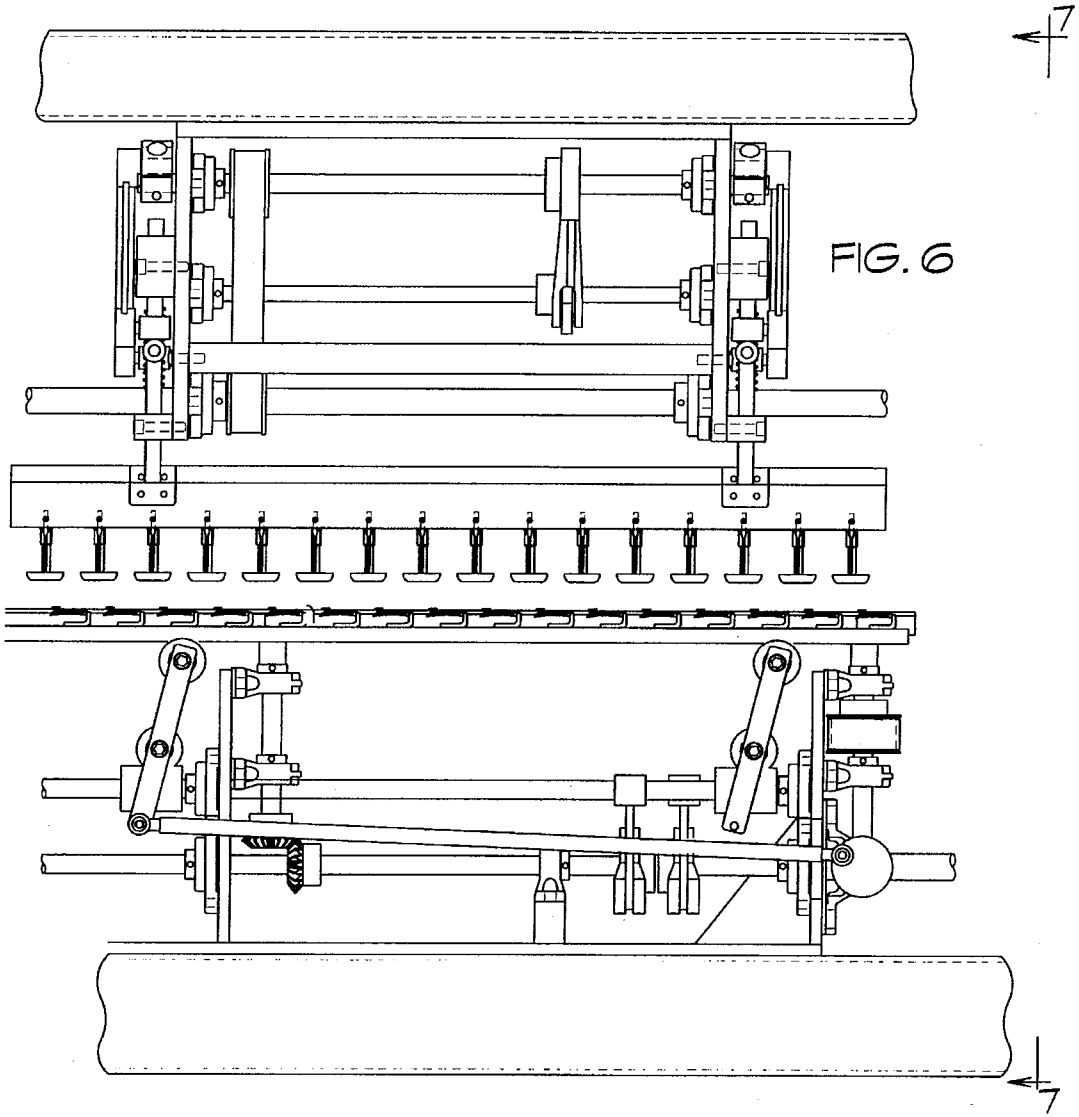
Figure 9:
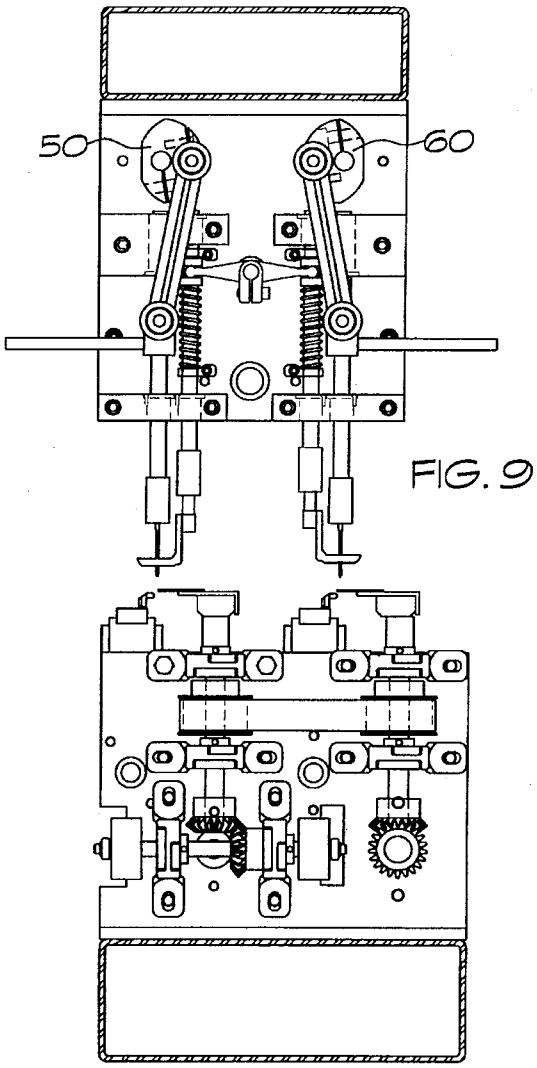
Figure 8:
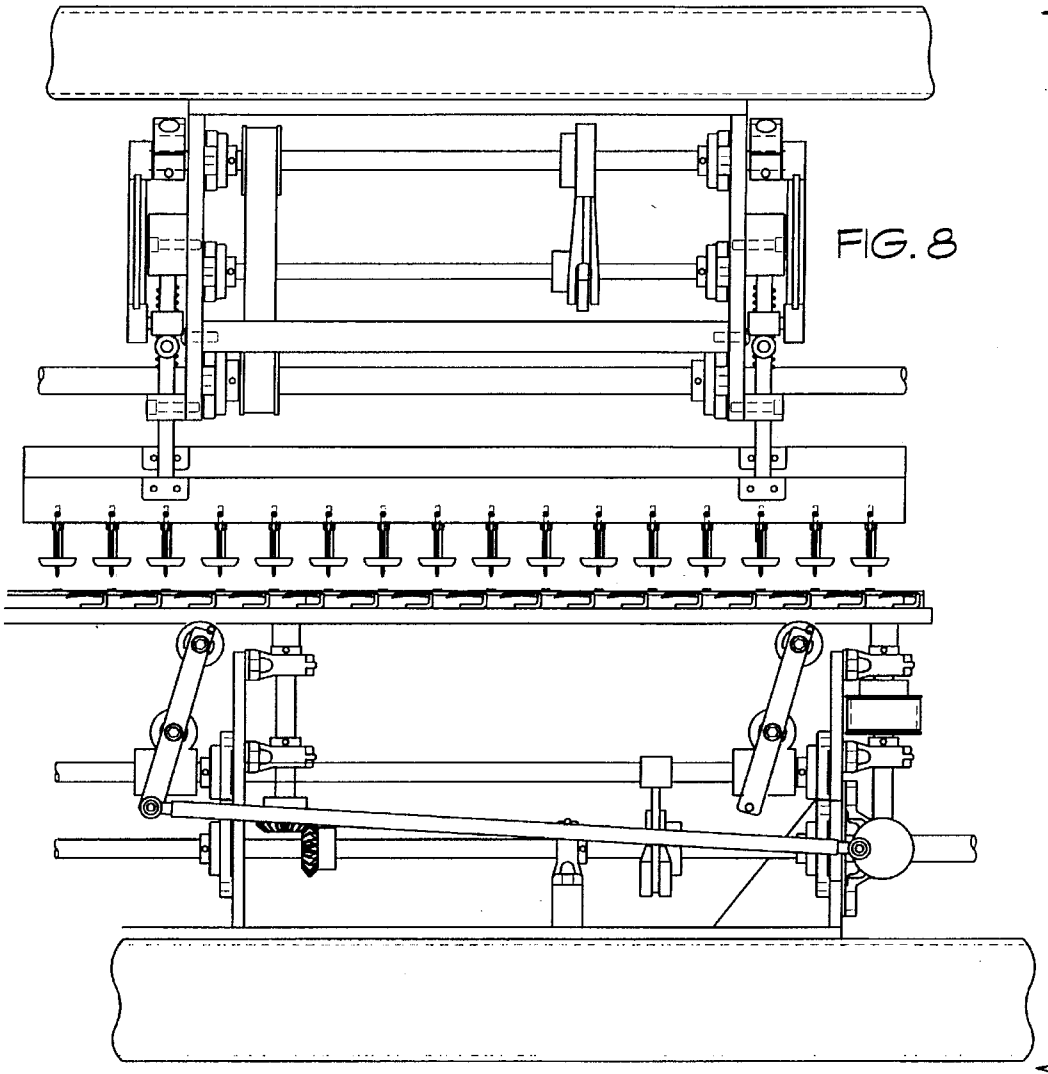
Figure 11:
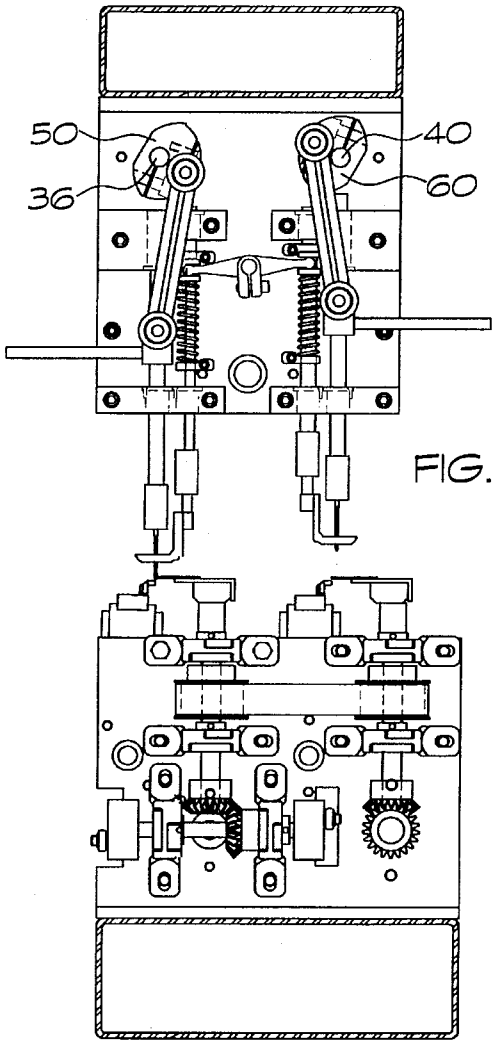
Figure 10:
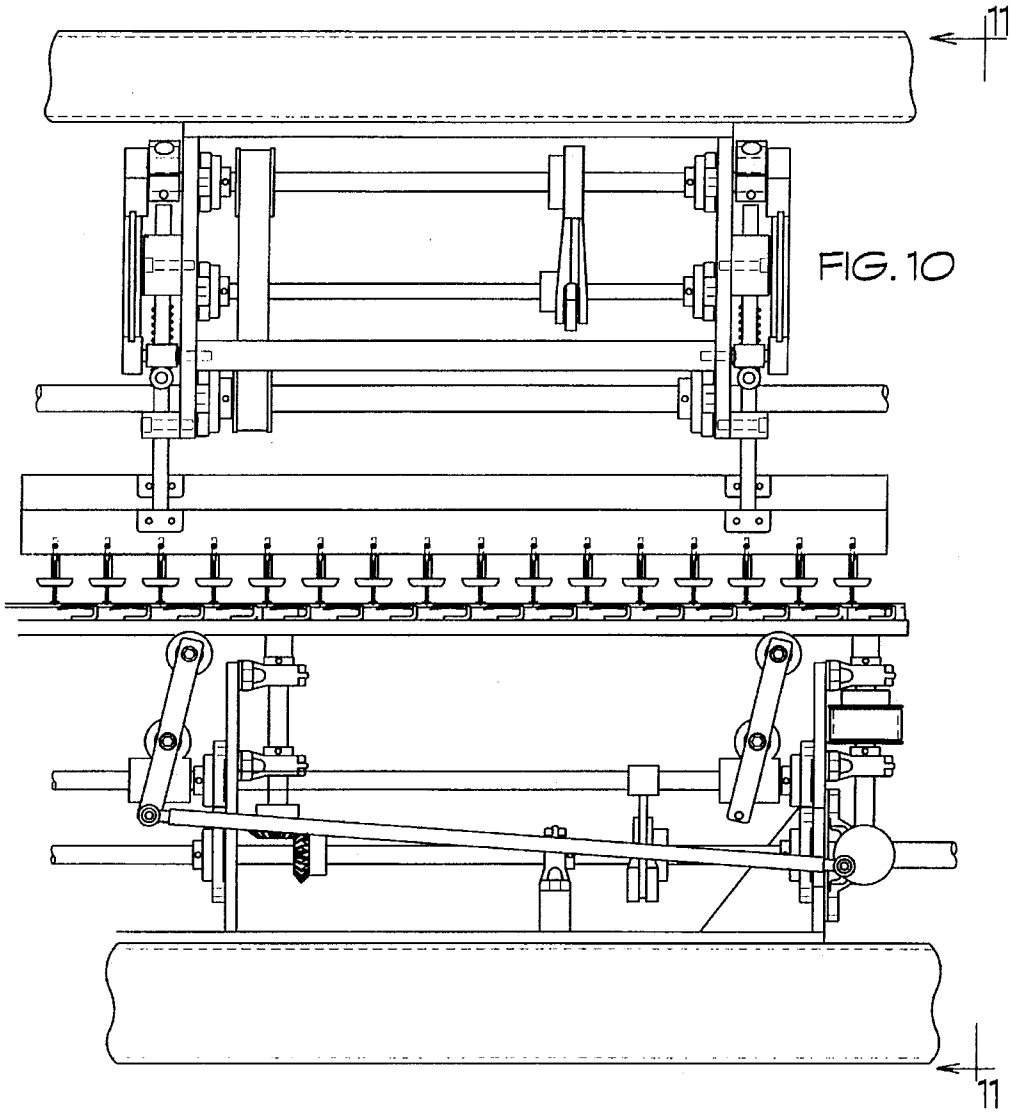
Figure 13:
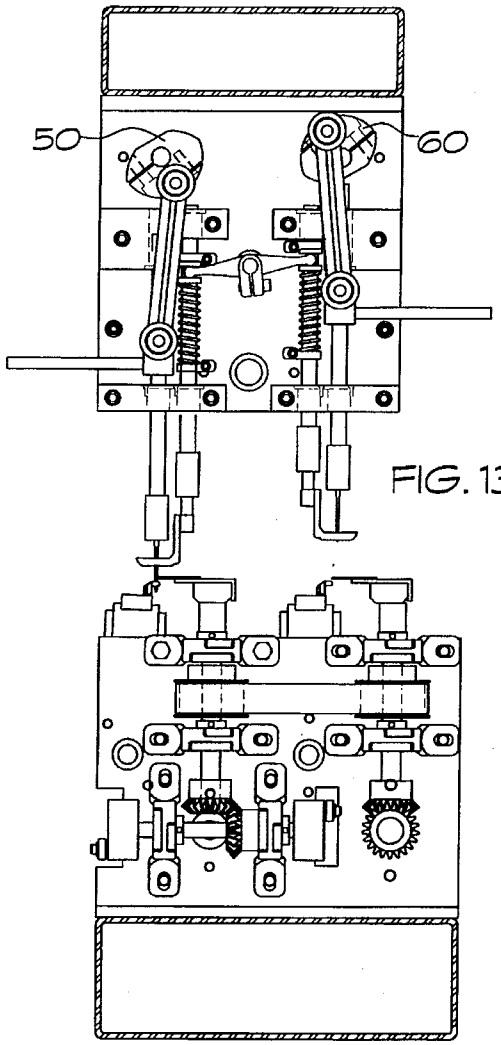
Figure 12:
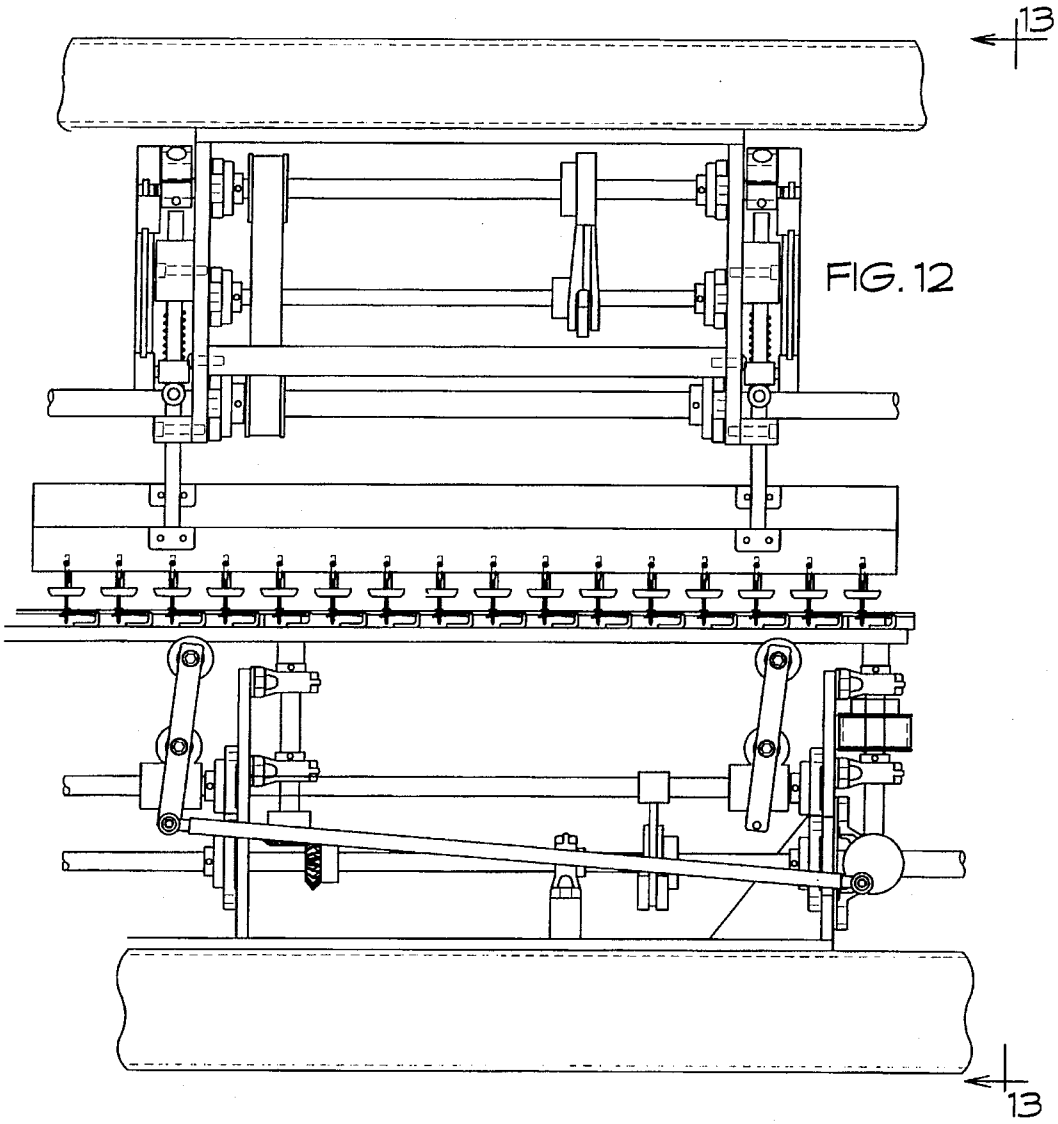
Figure 15:
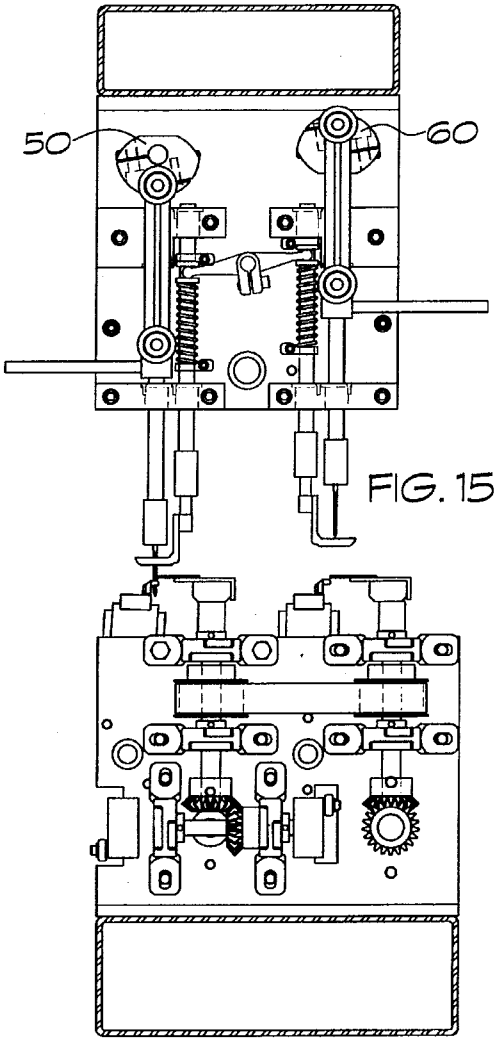
Figure 14:
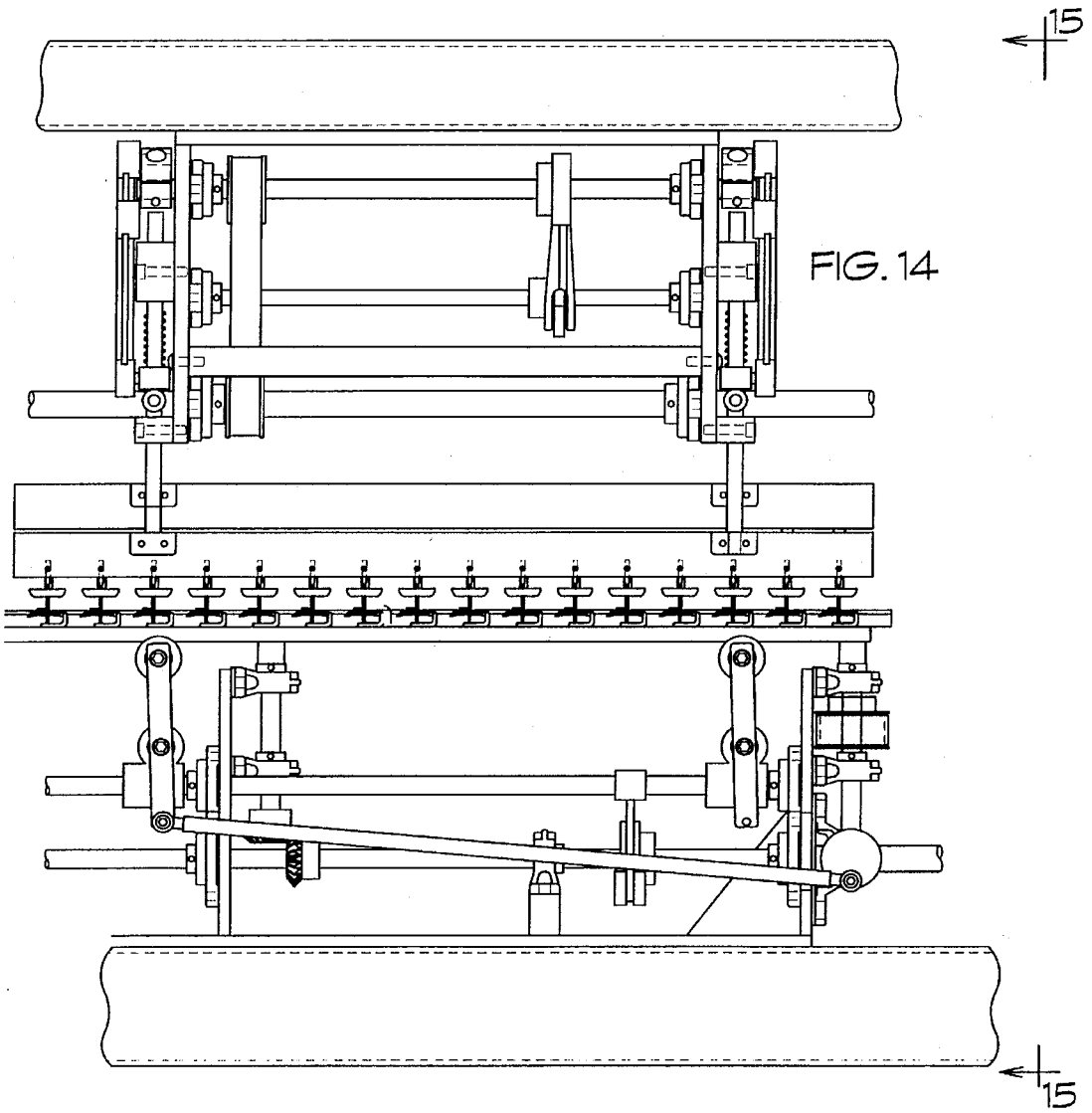
Figure 17:
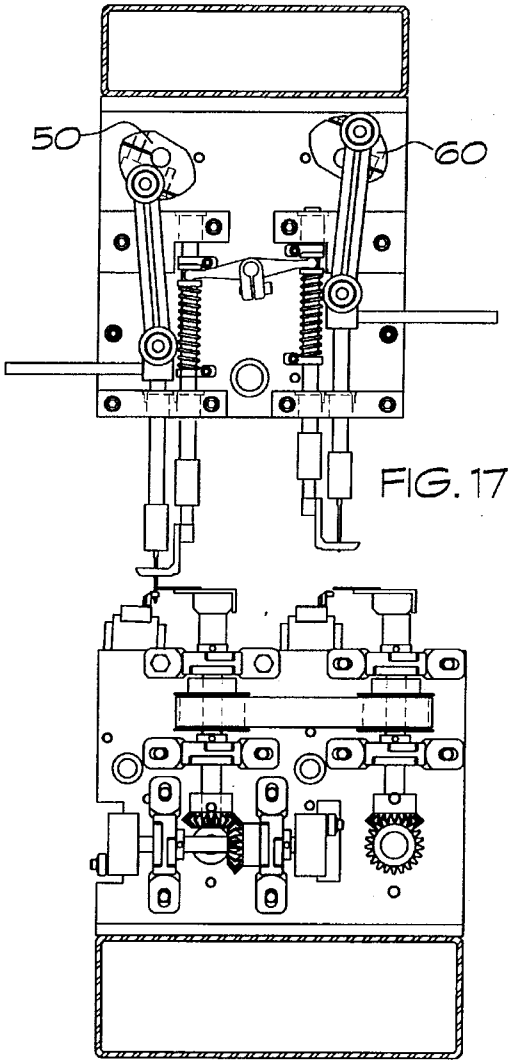
Figure 16:
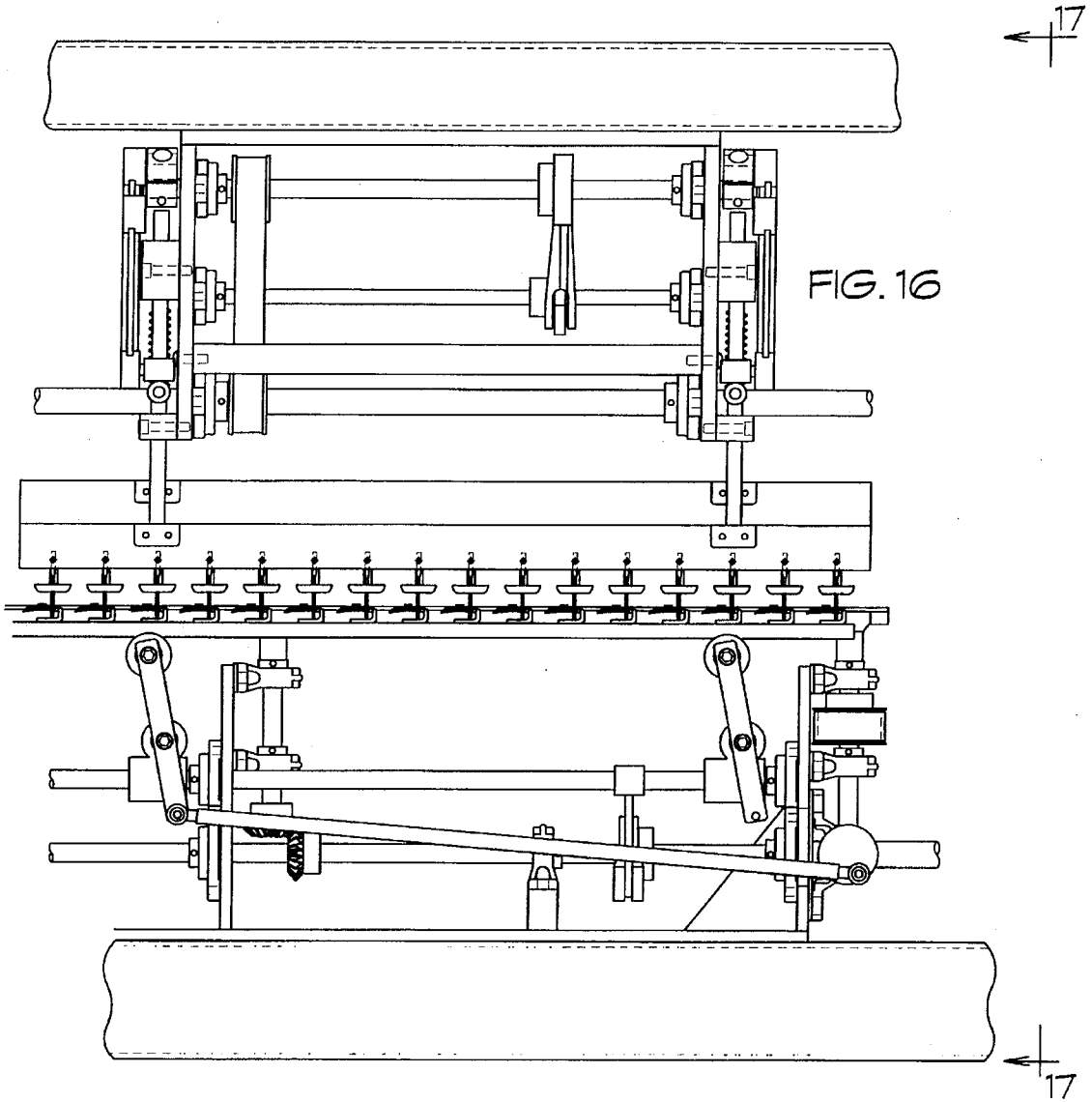
Figure 19:
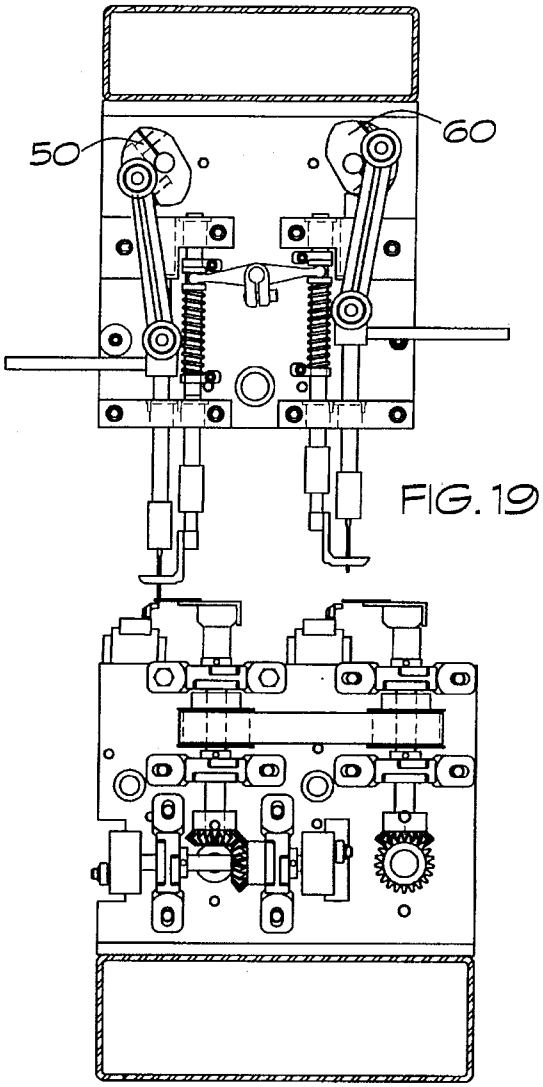
Figure 18:
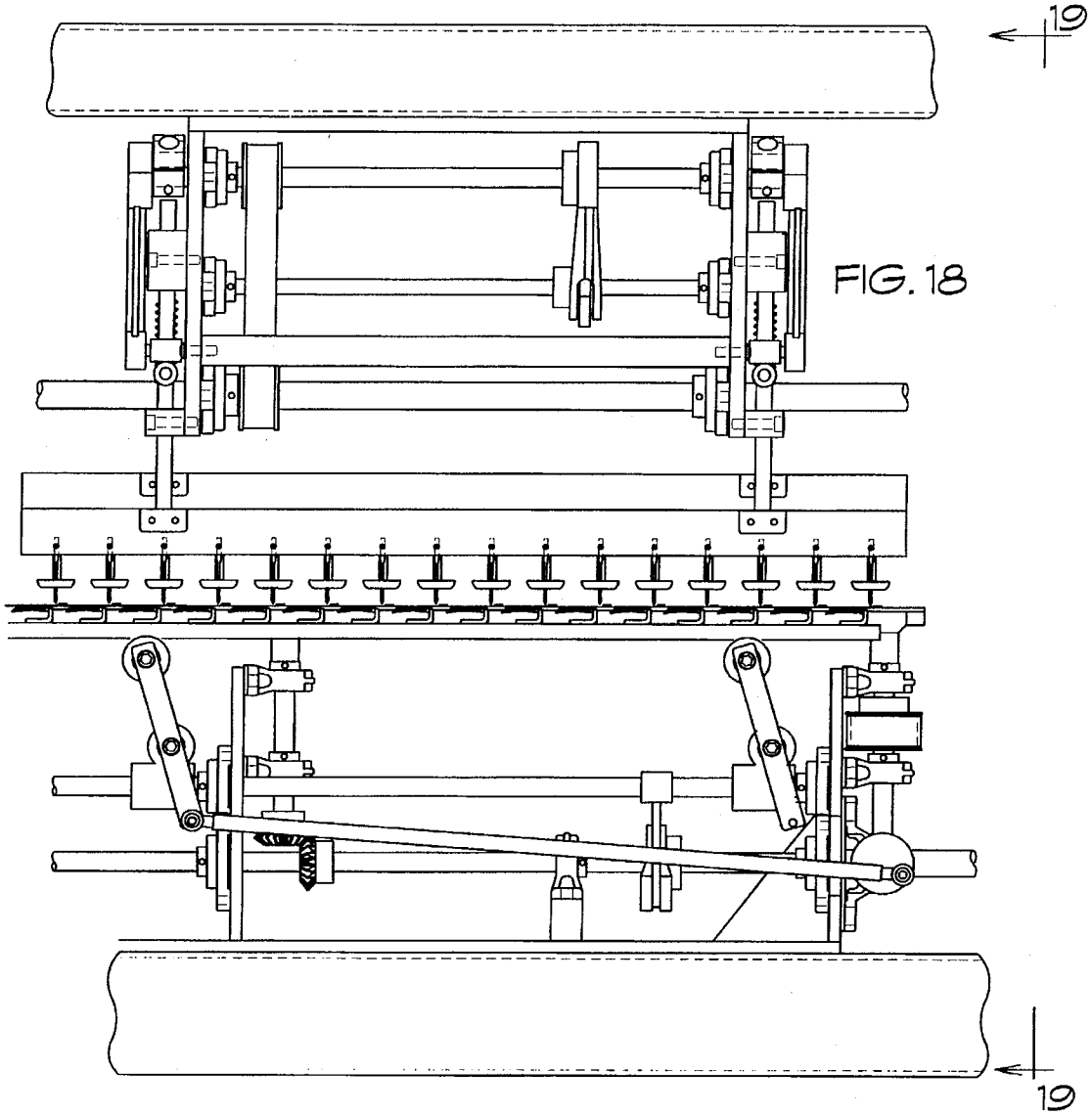
Figure 21:
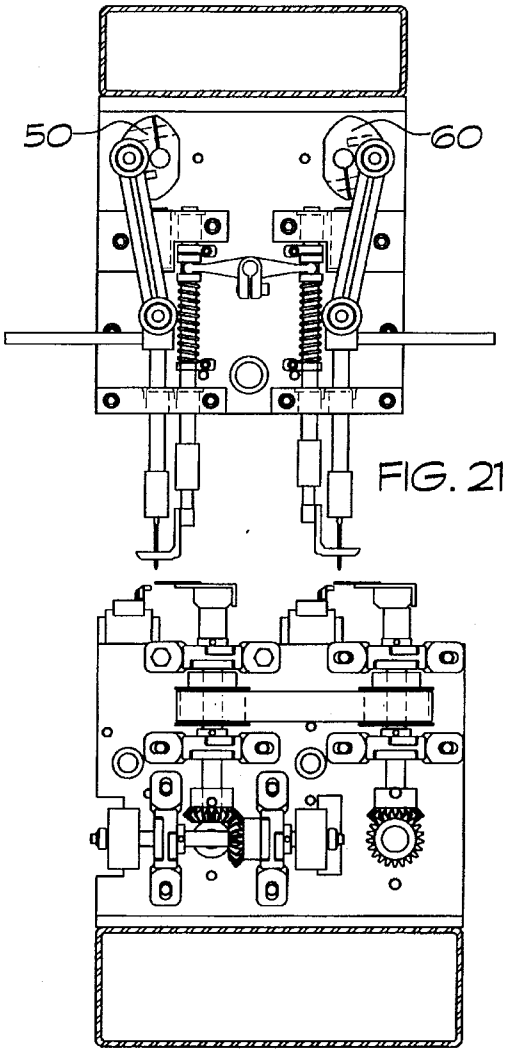
Figure 20:
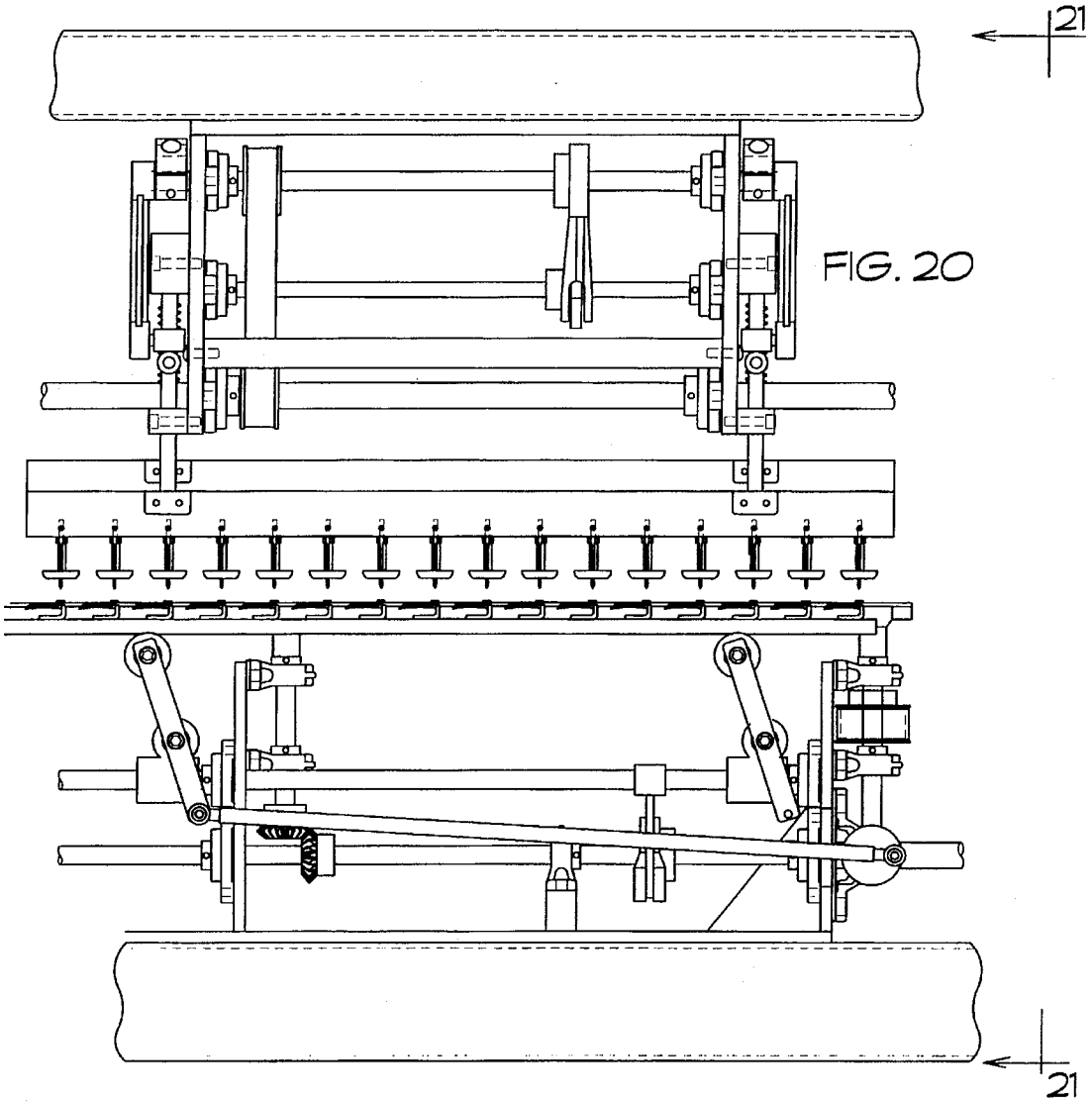
Figure 23:
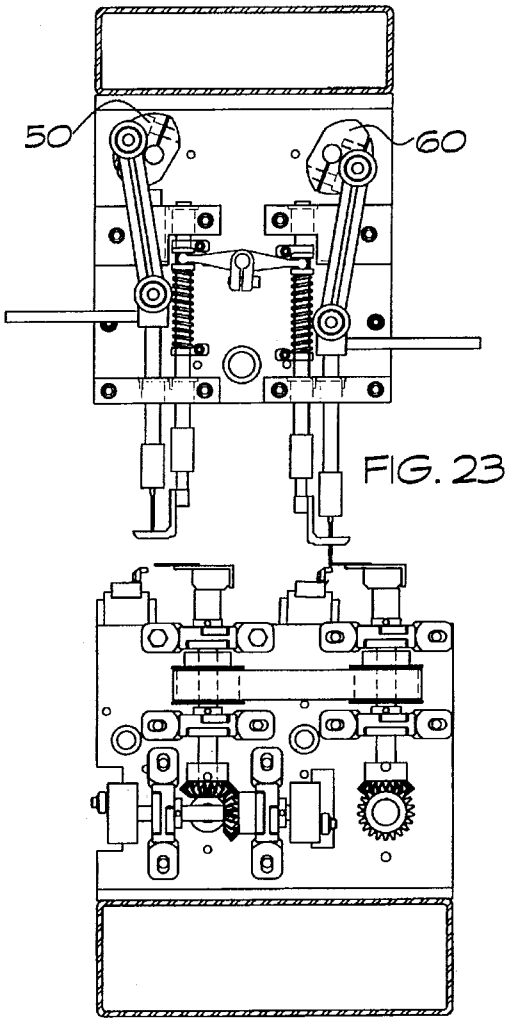
Figure 22:
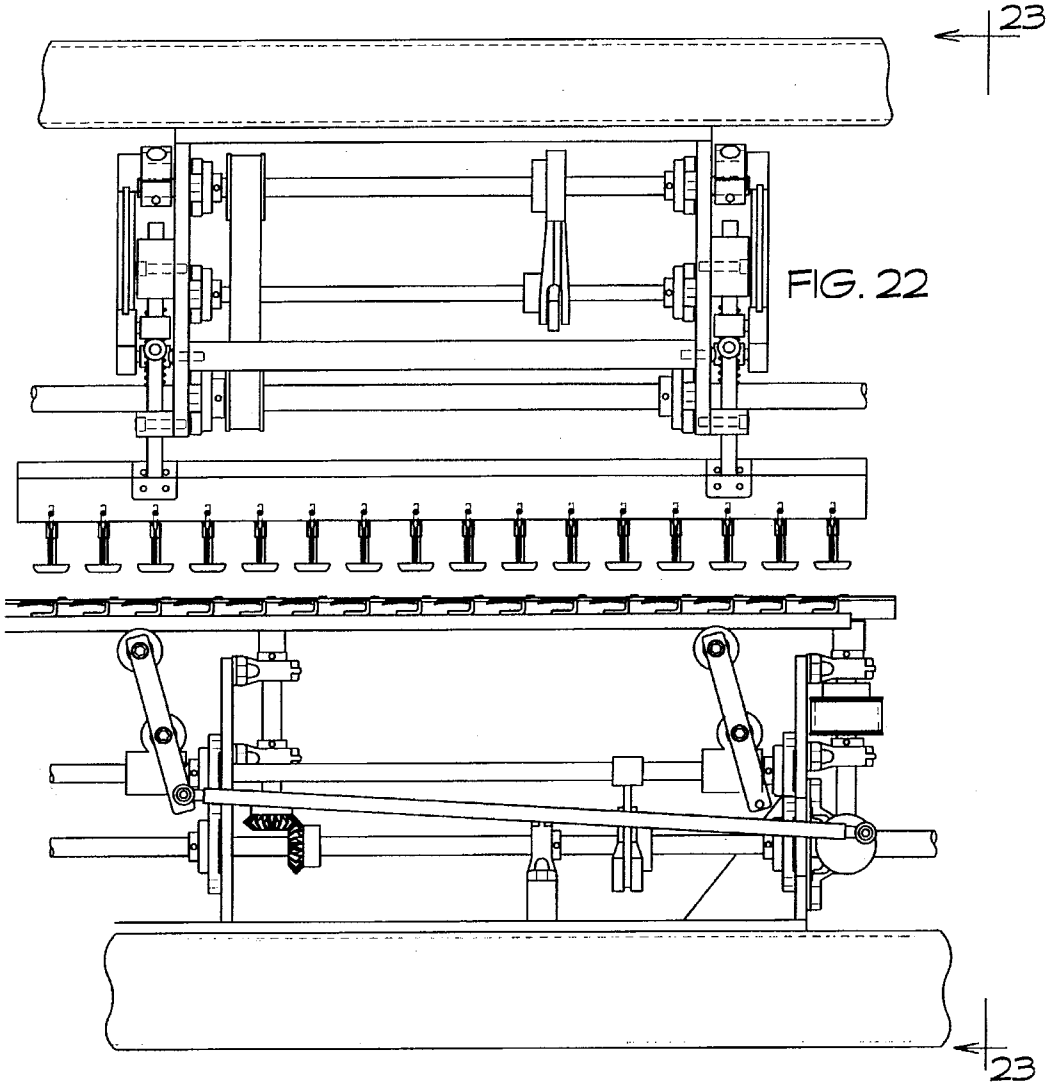
Figure 25:
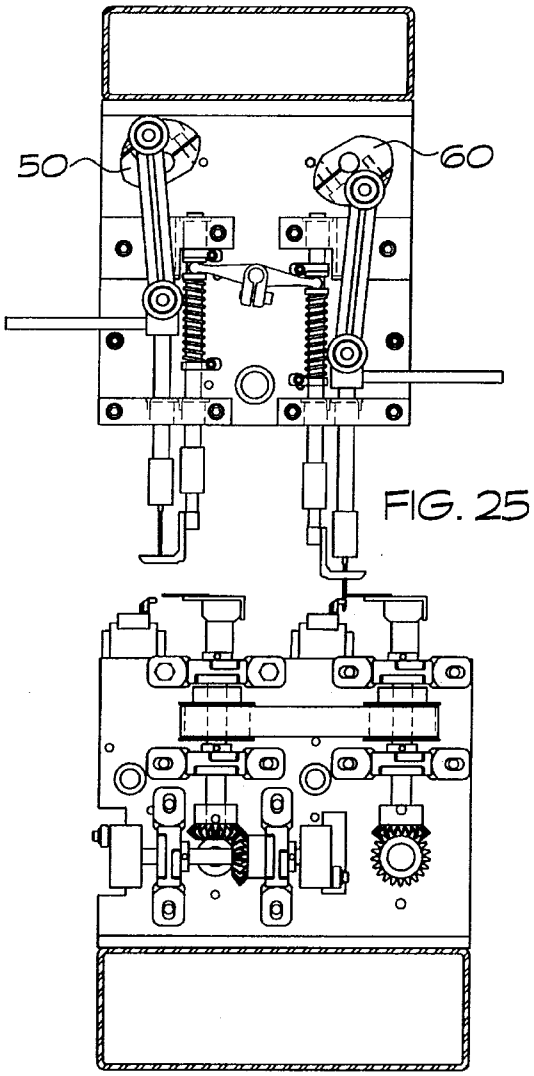
Figure 24:
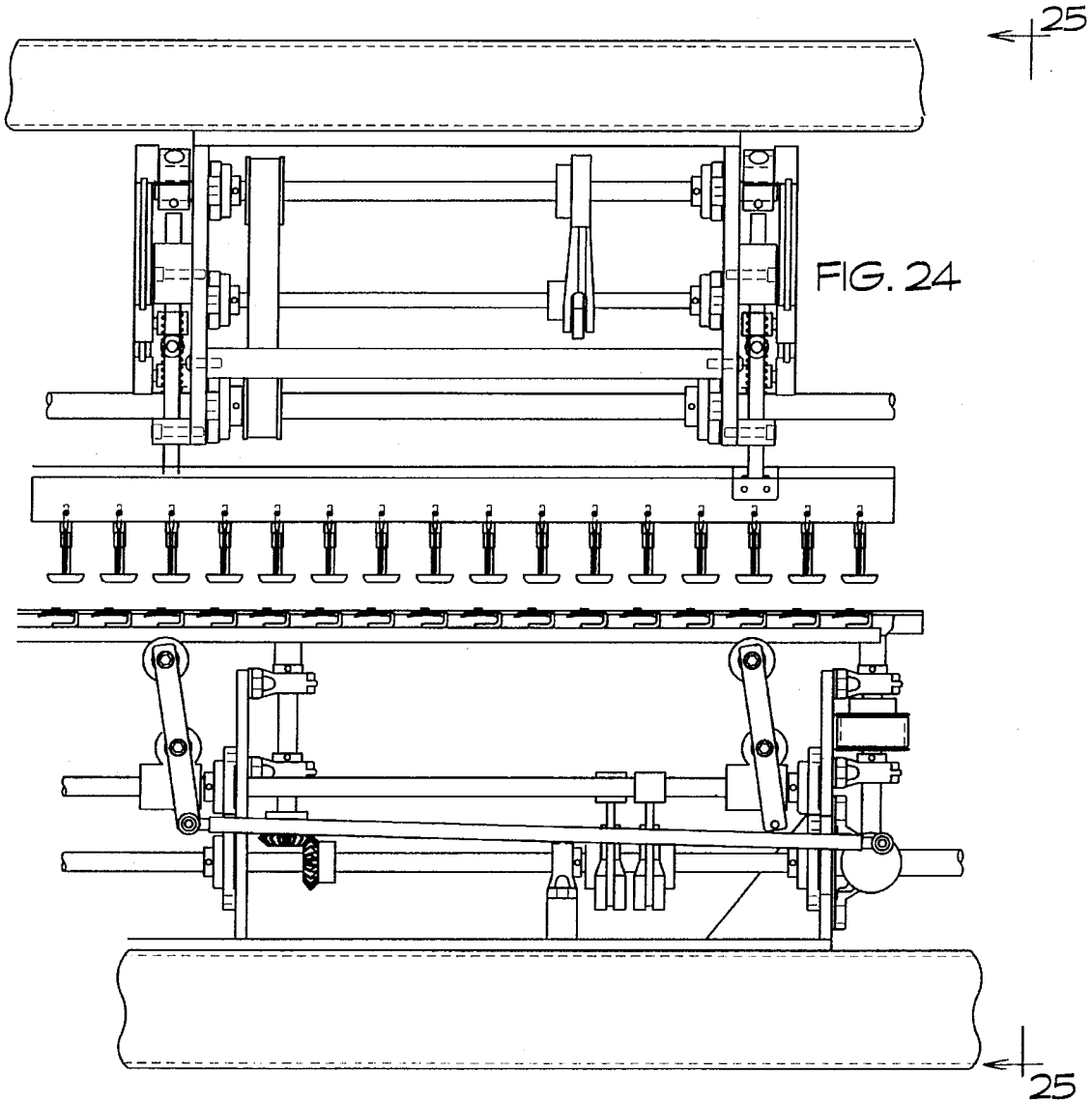
Figure 26:
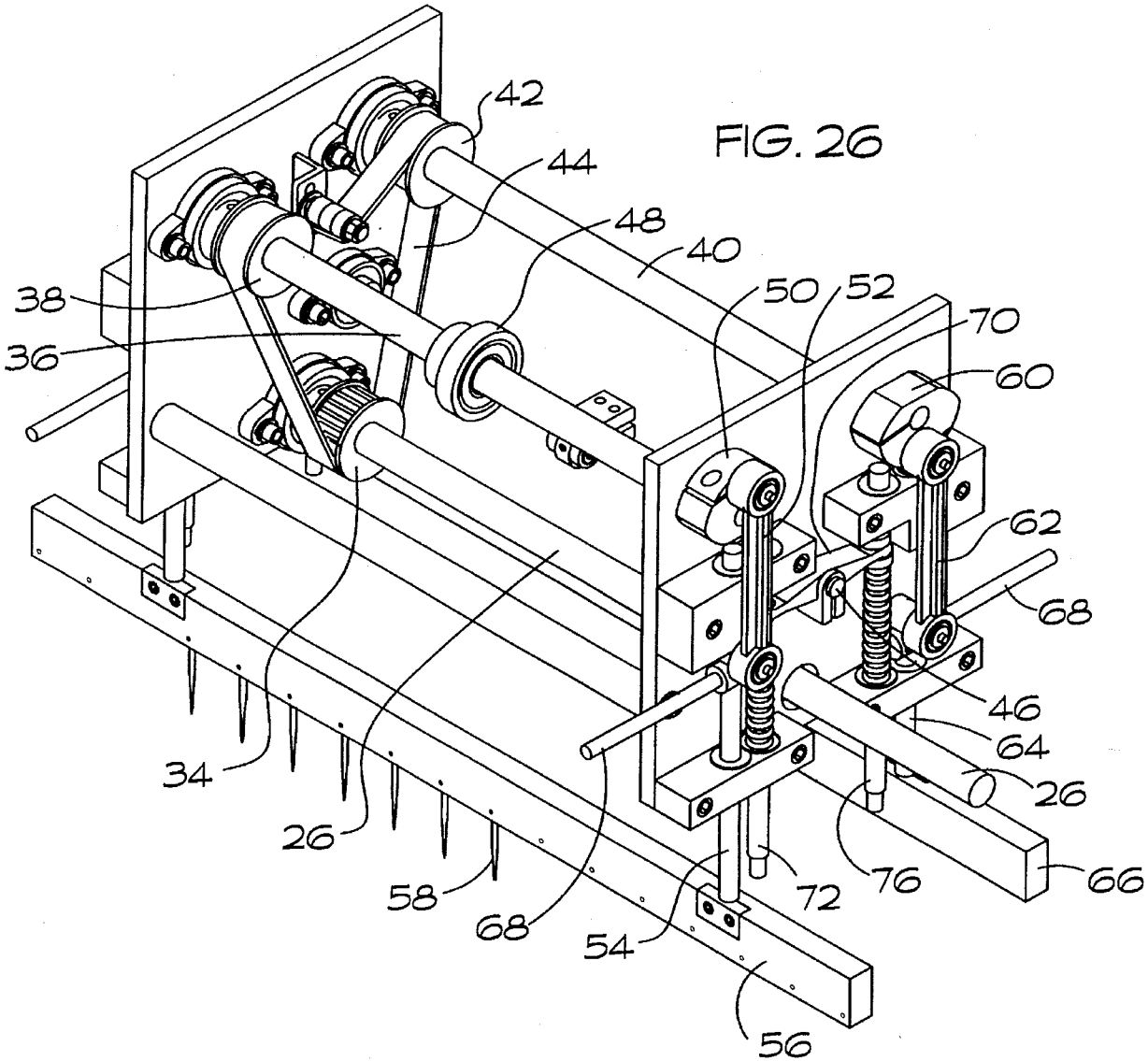
FIG. 26 shows a perspective view of a selected portion of an upper sewing assembly, wherein the needle bar cranks rotate in the same direction.

FIGS. 2/3 show front needle bar 56 and front presser bar 74 in their most downward position and rear needle bar 66 and rear presser bar 78 in their most upward position. With reference to FIGS. 2–25, front needle bar crank 50 and rear needle bar crank 60 are shown rotating in the same clockwise direction (when viewed from the odd numbered drawings). This is the configuration explained with FIG. 26 above. Cranks 50/60 could also rotate in opposite directions, as was explained with reference to FIG. 27 above. FIGS. 2/3, 4/5, 6/7, 8/9, 10/11, 12/13, 14/15, 16/17, 18/19, 20/21, 22/23, and 24/25 show the relative movements of the sewing components of the quilter 10 at respective thirty degree advancements of cranks 50/60. For example, cranks 50/60 of FIGS. 6/7 have rotated sixty degrees clockwise from their position in FIGS. 2/3 and cranks 50/60 of FIGS. 8/9 have rotated ninety degrees clockwise from their position of FIGS. 2/3.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A quilting machine assembly for moving a front looper bar in a desired direction and simultaneously moving a rear looper bar in an opposed direction, said assembly comprising:

a front looper crank having a first axis, said front looper crank having an off-set bore therein, said off-set bore being a preselected distance from said first axis;

a rear looper crank having a second axis, said rear looper crank having an off-set bore therein, said off-set bore being said preselected distance from said second axis;

a looper shaft having a looper shaft axis and a front looper end and a rear looper end, said front looper end having said front looper crank connected thereto, said rear looper end having said rear looper crank connected thereto, said first axis and said second axis and said looper shaft axis being in a coaxial relationship, said front looper crank off-set bore and said rear looper crank off-set bore being in a diametrically opposed relationship, said looper shaft having means for rotating said looper shaft connected thereto;

a front looper drive bar connected between said front looper bar and said front looper crank off-set bore;

a rear looper drive bar connected between said rear looper bar and said rear looper crank off-set bore;

whereby, when said looper shaft rotating means rotates said looper shaft and said front and rear looper cranks, said front looper drive bar causes said front looper bar to move in said desired direction and said rear looper drive bar causes said rear looper bar to move in said opposed direction.

2. The quilting machine assembly of claim 1, where said connection between said front looper drive bar and said front looper bar is an indirect connection, the front looper drive bar and front looper bar having a front looper pivot therebetween; and, where said connection between said rear looper drive bar and said rear looper bar is an indirect connection, the rear looper drive bar and rear looper bar having a rear looper pivot therebetween.

3. The quilting machine of claim 1, where said means for rotating said looper shaft and means for rotating a front and a rear spreader shaft are coupled.

4. A multi-needle quilting machine, comprising:

a sewing frame carriage having at least one upper sewing assembly and a lower sewing assembly, said at least one upper sewing assembly having an upper main shaft passing therethrough, said lower sewing assembly having a lower main shaft passing therethrough, said sewing frame carriage having means for driving said upper and lower main shafts;

said at least one upper sewing assembly having a front needle bar having at least one needle connected thereto; said at least one upper sewing assembly having a corresponding front presser foot bar having at least one presser foot connected thereto; said at least one upper sewing assembly having a rear needle bar having at least one needle connected thereto; said at least one upper sewing assembly having a corresponding rear presser foot bar having at least one presser foot connected thereto;

said at least one upper sewing assembly having means for driving said front needle bar and said corresponding front presser foot bar and said rear needle bar and said corresponding rear presser foot bar vertically up and down, said driving means being coupled to said upper main shaft, where driving means moves said front needle bar with said corresponding front presser foot bar and said rear needle bar with said corresponding rear presser foot bar in an out of phase relationship;

said lower sewing assembly having a front spreader bar having at least one spreader connected thereto; said lower sewing assembly having a corresponding front looper bar having at least one looper connected thereto; said lower sewing assembly having a rear spreader bar having at least one spreader connected thereto; said lower sewing assembly having a corresponding rear looper bar having at least one looper connected thereto;

said lower sewing assembly having means for driving said front spreader bar in a first horizontal circle and said rear spreader bar in a second out of phase horizontal circle, said driving means being coupled to said lower main shaft;

said lower sewing assembly having means for driving said front looper bar in a left and right direction and means for rocking said front looper in a front and back direction, where said front looper bar moves in a first oblong pattern;

said lower sewing assembly means for driving said front looper bar in a left and right direction also driving said rear looper bar in an out of phase right and left direction, said means for rocking said front looper in a front and back direction also rocking said rear looper bar in an out of phase left and right direction, where said rear looper bar moves in a second out of phase oblong pattern.

5. The multi-needle quilting machine of claim 4, where said means for driving said front needle bar and said corresponding front presser foot bar and said rear needle bar and said corresponding rear presser foot bar vertically up and down further comprises:

at least two rotating front needle bar cranks having a first axis of rotation, at least two front needle bar shafts, each front needle bar shaft having a needle bar end and a crank end, said needle bar ends of said front needle bar being connected to said front needle bar, each said front needle crank and said corresponding front needle bar crank end having a connector link therebetween, each said connector link connected to said corresponding rotating front needle bar crank at a crank location different from said first axis of rotation;

at least two rotating rear needle bar cranks having a second axis of rotation, at least two rear needle bar shafts, each rear needle bar shaft having a needle bar end and a crank end, said needle bar ends of said rear needle bar being connected to said rear needle bar, each said rear needle crank and said corresponding rear needle bar crank end having a connector link therebetween, each said connector Link connected to said corresponding rotating rear needle bar crank at a crank location different from said second axis of rotation;

where, said at least two rotating front needle bar cranks and said at least two rotating rear needle bar cranks rotate in a same direction.

6. The multi-needle quilting machine of claim 4, where said means for driving said front needle bar and said corresponding front presser foot bar and said rear needle bar and said corresponding rear presser foot bar vertically up and down further comprises:

at least two rotating front needle bar cranks having a first axis of rotation, at least two front needle bar shafts, each front needle bar shaft having a needle bar end and a crank end, said needle bar ends of said front needle bar being connected to said front needle bar, each said front needle crank and said corresponding front needle bar crank end having a connector link therebetween, each said connector link connected to said corresponding rotating front needle bar crank at a crank location different from said first axis of rotation;

at least two rotating rear needle bar cranks having a second axis of rotation, at least two rear needle bar shafts, each rear needle bar shaft having a needle bar end and a crank end, said needle bar ends of said rear needle bar being connected to said rear needle bar, each said rear needle crank and said corresponding rear needle bar crank end having a connector link therebetween, each said connector link connected to said corresponding rotating rear needle bar crank at a crank location different from said second axis of rotation;

where, said at least two rotating front needle bar cranks rotate in a first direction and said at least two rotating rear needle bar cranks rotate in a second direction, said second direction being opposed said first direction.

7. The multi-needle quilting machine of claim 4, where said means for driving said front spreader bar in a first horizontal circle and said rear spreader bar in a second out of phase horizontal circle further comprises at least two rotating front spreader bar shafts and at least two rotating rear spreader bar shafts, each of said front and rear spreader bar shafts having an axis of rotation, each of said front and rear spreader bar shafts having an end bore therein, each said end bore off-set a preselected distance from said axis of rotation, said front spreader bar connected to said front spreader bar shafts at said front spreader bar shafts end bores and said rear spreader bar connected to said rear spreader bar shafts at said rear spreader bar shafts end bores, said at least one of said rotating front spreader bar shafts and at least one of said rotating rear spreader bar shafts having a timing belt therebetween, at least one of said at least two front spreader bar shafts and said at least two rear spreader bar shafts being transversely coupled to said lower main shaft.

8. The multi-needle quilting machine of claim 7, where said at least one of said at least two front spreader bar shafts and said at least two rear spreader bar shafts has a rotating looper shaft transversely coupled thereto, said looper shaft having a looper shaft axis of rotation, said looper shaft having a front end and a rear end, each end having a looper crank connected thereto, each said looper crank having an off-set bore therein, each said off-set bore being a preselected distance from said looper shaft axis of rotation, each said looper crank off-set bore having a looper drive bar connected thereto, one of said looper drive bars being connected to said front looper bar, the other of said looper drive bars being connected to said rear looper bar, where said rotating looper shaft thereby rotates said looper cranks providing said means for driving said front looper bar in a left and right direction and said rear looper bar in an out of phase right and left direction.

9. The multi-needle quilting machine of claim 8, where said connection between said one of said looper drive bars and said front looper bar is an indirect connection, the respective looper drive bar and looper bar having a front looper pivot therebetween; and, where said connection between said other of said looper drive bars and said rear looper bar is an indirect connection, the respective looper drive bar and looper bar having a rear looper pivot therebetween.

10. The multi-needle quilting machine of claim 4, wherein said machine employs a plurality of sealed bearings and, therefore, requires no oiling.

* * * * *